US005332148A

United States Patent [19]

Liu et al.

[11] Patent Number: 5,332,148

[45] Date of Patent: Jul. 26, 1994

[54] PAPER BOARD FOLDABLE INTO A CONTAINER WITH MULTIPLE COMPARTMENTS

[76] Inventors: Yuan-Hsin Liu, 11th-1 Floor, No. 90, Fu Hsin S. Road, Sec. 1, Tah An District, Taipei, Taiwan; Richard C. H. Chang, 19, Alley 2, Lane 685, Chung Cheng Road, Faun Yuan City, Taichung Hsien, Taiwan

[21] Appl. No.: 107,994

[22] Filed: Aug. 18, 1993

[51] Int. Cl.[5] ..... B65D 5/48

[52] U.S. Cl. ..... 229/120.17; 229/2.5 R; 229/120.12; 229/186

[58] Field of Search ..... 229/2.5 R, 120.12, 120.17, 229/125.35, 186; 220/416, 417, 462

[56] References Cited

U.S. PATENT DOCUMENTS

| | | | |
|---|---|---|---|
| 2,591,548 | 4/1952 | Inman | 229/120.17 |
| 3,084,790 | 4/1963 | Vanderlugt, Jr. | 229/120.17 |
| 3,771,713 | 11/1973 | Davidson | 229/120.12 |
| 4,192,443 | 3/1980 | McLaren | 229/120.17 |
| 4,202,465 | 5/1980 | McLaren | 229/120.17 |
| 4,722,474 | 2/1988 | Dropsy | 220/462 |
| 4,944,451 | 7/1990 | Forbes, Jr. | 229/125.35 |
| 5,009,363 | 4/1991 | Zavatone | 229/120.17 |
| 5,056,709 | 10/1991 | Cargile, Jr. | 229/120.17 |
| 5,236,119 | 8/1993 | Chu | 229/2.5 R |

*Primary Examiner*—Gary E. Elkins
*Attorney, Agent, or Firm*—Bacon & Thomas

[57] ABSTRACT

A paper container with multiple variable compartments which is formed from a paper board of adequate thickness cut into a predetermined pattern. The paper board is made of paper of pure fibers and additives, laminated to adequate thickness and coated with polyethylene to meet the FDA regulations. The paper pattern is formed with inner openings and embossed with a plurality of folding lines, whereby the paper pattern can be folded about the folding lines and heat-sealed by means of molds to form a container having multiple variable compartments of which the size, shape and number can be varied through changing the positions, numbers and shapes of the inner openings so as to more suitably contain various foods or articles and facilitate the package thereof.

6 Claims, 5 Drawing Sheets

PAPER BOARD FOLDABLE INTO A CONTAINER WITH MULTIPLE COMPARTMENTS

BACKGROUND OF THE INVENTION

The present invention relates to a paper container with multiple variable compartments which is formed from a paper board in proper thickness. The paper board is cut into a predetermined pattern with some portions thereof removed and a plurality of folding lines embossed in advance, whereby the paper board can be folded about the folding lines and then heat-sealed to form a container having a large compartment and two small compartments. To meet different requirements, the numbers, positions and shapes of the removed portions and folding lines can be changed to give the compartments different sizes, shapes, and positions, allowing the paper container to contain various kinds of food and article of different shapes and volumes.

Conventional food containers are mainly made of paper, polymer or plastic, wherein the polymer-made container is integrally formed from the foaming material and the plastic-made container is formed from melted plastic molded in a set of upper and lower molds. Both of the polymer and plastic made food containers can be formed with several compartments to meet the requirements of containing foods. Basically, the advantages of these partitioned polymer and plastic made food containers are convenient in use and easy to manufacture. However, such containers are not subject to natural decomposition after they are used and discarded, and therefore,. will cause serious pollution of and detriment to the whole ecological environment that will cost the entire society a higher price to protect the environment. Therefore, the polymer and plastic made food containers are gradually given up by the users.

The paper container is mainly made from a paper board cut into a predetermined pattern with a plurality of folding lines embossed in advance which define several sections of the container. The paper board can be folded about the pre-embossed folding lines such that four wall sections and corner sections are formed, then, the corner sections so formed are overlapped and attached to the wall sections to form a container having one single compartment. To contain different kinds of solid or liquid foods without mixing their different tastes and flavors, several partitioning paper cards are disposed inside the container, giving it several compartments. Such paper cards are not fixedly disposed and are likely to shift due to the movement of the contained foods. As a result, the contained foods are still easy to mix with one another and lose their original tastes. Although the paper container is subject to natural decomposition and the environment pollution caused thereby is relatively low, the conventional paper container is not so practical in use and would need improvement.

It is therefore a need to develop an improved paper container which has secure multiple compartments and can be easily manufactured to eliminate the above shortcomings existing in the conventional paper container.

SUMMARY OF THE INVENTION

It is a primary object of the present invention to provide an improved paper container with multiple compartments. The paper container is formed from a paper board meeting the FDA regulations by cutting the same into a predetermined pattern. The paper pattern has a specially designed configuration with some portions thereof cut away and a plurality of folding lines embossed in advance to define three bottom sections and a plurality of wall sections between and surrounding the bottom sections. While some of the wall sections can be folded about folding lines between them to form erected partitioning walls separating the bottom sections and thereby form three compartments, the other wall sections form outer peripheral walls of the container. The peripheral walls are provided with top edge strips and corner connection sections. By means of molds, the pheripheral walls, the top edge strips thereof, and the, corresponding corner connection sections can be folded, overlapped and heat-sealed to form a paper container with three compartments for conveniently containing more kinds of food.

It is a further object of the present invention to provide the above paper container, wherein the portions pre-cut away are located between the corner connection sections at the joints of the partitioning wall sections and therefore, by means of varying the position of the pre-cut away portions and the related partitioning wall sections and corner connection sections, the volume, shape and position of the individual compartments can be changed to contain different kinds of food.

It is still a further object of the present invention to provide the above paper container, wherein the originally generally upside-down T-shaped unfolded paper pattern of the container is extended from the outer side of the large bottom section to form a generally I-shaped paper pattern such that two pairs of laterally symmetrically disposed small bottom sections and a laterally symmetrical large middle bottom section located therebetween are formed. Therefore, the numbers of the compartments increase to five.

It is still a further object of the present invention to provide the above paper container, wherein some of the partitioning wall sections of the bottom sections can be alternatively designed to have less width and the adjacent corner connection sections can correspondingly have less height so that after the paper pattern is folded and heat-sealed to form the container, the same will have lower partitioning walls.

It is still a further object of the present invention to provide the above paper container, wherein two ends of each of the top edge strips are outward tapered to form two slightly inclined lateral sides, whereby the top edge strips can be smoothly folded and heat-sealed to the corresponding peripheral wall sections to secure and beautify top edges of the container.

The structure, features, functions, and other objects of the present invention, and the technical means adopted to achieve the present invention can be best understood through the following detailed description of the preferred embodiments and the accompanying drawings wherein:

DETAILED DESCRIPTION OF THE PREFERRED EMBODIMENTS

Figure 1:
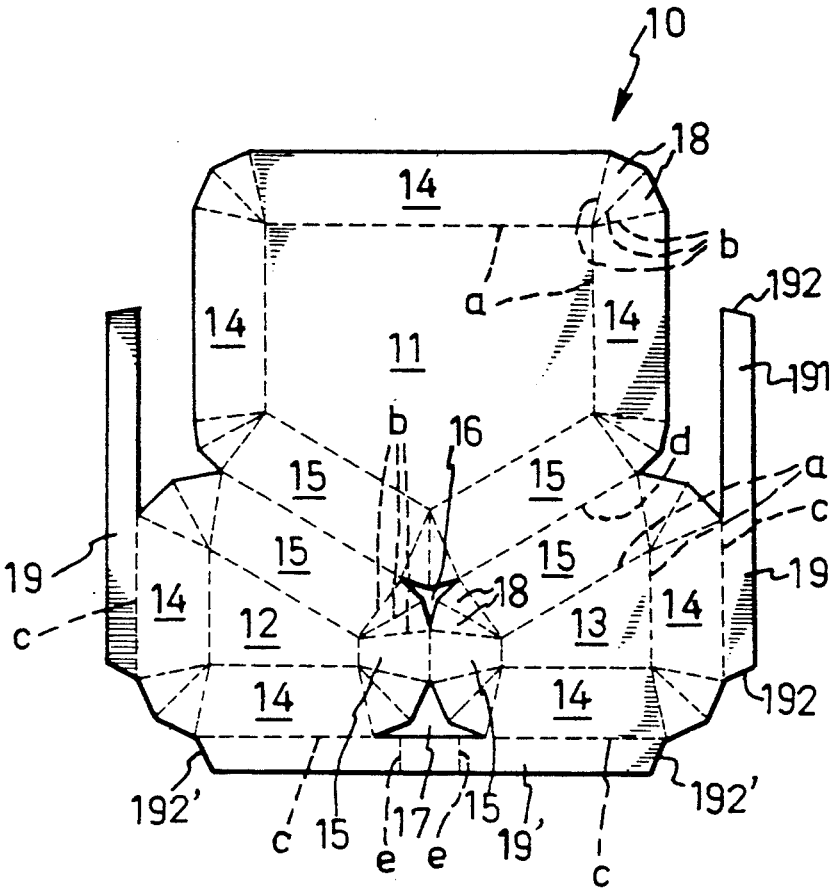
FIG. 1 is an unfolded paper pattern of a first embodiment of the paper container according to the present invention.
Figure 4:
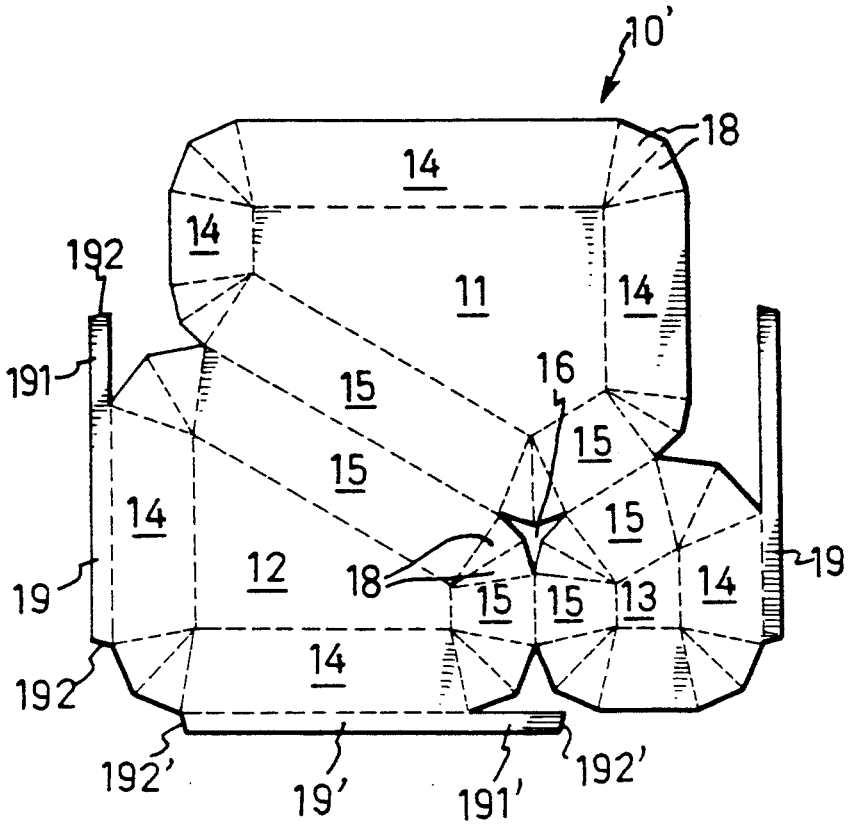
FIG. 4 is an unfolded paper pattern of a second embodiment of the paper container of the present invention.

The present invention is a paper container 10 which is formed from a paper board made of paper of pure fibers and additives being laminated to adequate thickness and coated with polyethylene to meet the FDA regulations. The paper board is cut to a paper pattern of predetermined configuration, a first embodiment of which is shown in FIG. 1. The paper pattern of FIG. 1 is formed with a first opening 16 and a second opening 17 and a plurality of embossed folding lines a, b, c, d, e, whereby the paper pattern can be folded about the folding lines a through e by means of molds and heat-sealed to form a container 10 having a laterally symmetrical large compartment 11 and two identical and laterally symmetrically disposed small compartments 12, 13. To meet different requirements, the numbers, positions and shapes of the first and second openings 16, 17 can be varied to give the compartments 11, 12, 13 different sizes, shapes and positions (as shown in FIG. 4); or, to form more compartments of different shapes and sizes for containing more kinds of food in a perfect manner.

Figure 2:
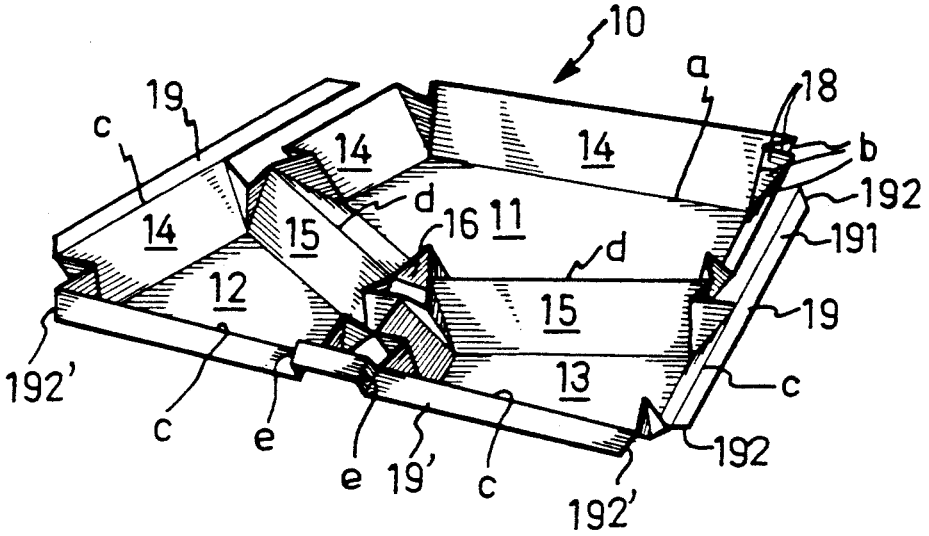
FIG. 2 shows the manner in which the paper container according to FIG. 1 is folded.

Please now refer to FIG. 1 which shows an unfolded paper pattern for forming the paper container 10 of the present invention, wherein the folding lines a are lines defining peripheral edges of the bottom sections 11, 12, 13. Bottom sections 11, 12, 13 are connected with one another by partitioning wall sections 15 with folding lines d located between two adjacent partitioning wall sections 15 whereby the adjacent partitioning wall sections 15 can be folded about the folding lines d to form an erected wall to separate the bottom sections 11, 12 and 13 from one another, as shown in FIG. 2. Peripheral wall sections 14 are adjacent to those edges a of bottom sections 11, 12, 13 that are not adjacent to partitioning wall sections 15. Three folding lines b are embossed at each corner section contained by two peripheral wall sections 14, by a peripheral wall section 14 and a partitioning wall section 15, or by two partitioning wall sections 15, permitting the corner section to form two adjacent and identical equiangular triangle-shaped corner connection sections 18. Bases of the corner connection sections 18 that locate between the partitioning wall sections 15 adjoin the first opening 16, whereby each two adjacent corner connection sections 18 thereof can be upward folded and overlapped to facilitate the forming of the large compartment 11 and the small compartments 12, 13 as shown in FIG. 3.

The peripheral wall sections 14 adjoining the small bottom sections 12, 13 further adjoin at an outer edge thereof two longitudinal top edge strip sections 19 and a transverse top edge strip section 19', wherein the transverse top edge strip section 19' is located in front of the small bottom sections 12, 13 and the second opening 17 and is formed at middle two parallel folding lines e across the width of the strip section 19'. The longitudinal top edge strip sections 19 adjoin the lateral peripheral wall sections 14 of the small bottom sections 12, 13. Each longitudinal top edge strip section 19 has a projected portion 191 extending toward the large bottom section 11. Two ends of each of the top edge strip sections 19, 19' are outward tapered, forming slightly inclined sides 192, 192', respectively.

Figure 3:
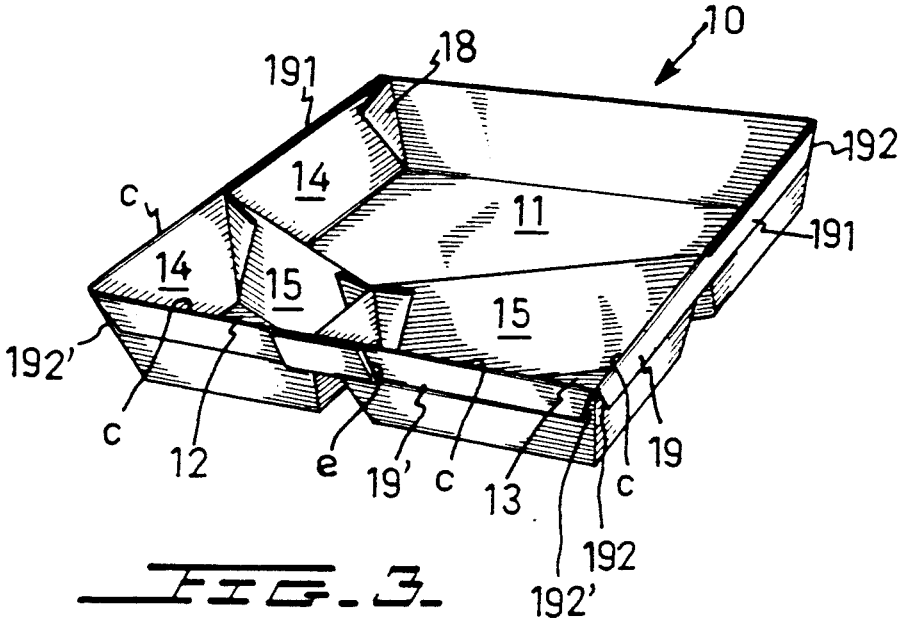
FIG. 3 shows the paper container formed from the paper pattern of FIG. 1, folded as shown in FIG. 2 and heat-sealed.

Please refer to FIGS. 2 and 3. The transverse and longitudinal top edge strip sections 19, 19' can be folded outward about the folding lines c and a part of the transverse top edge strip section 19' can be folded and overlapped by means of the folding lines e so that the transverse and longitudinal top edge strip sections 19, 19' can be separately fitted and attached and heat-sealed to the peripheral wall sections 14 with the projected portions 191 flush with the top edge of the peripheral wall sections 14 of the the large bottom section 11. Because the top edge strip sections 19, 19' have two inclined sides 192, 192', respectively, they can be attached to the peripheral wall sections 14, forming neatly connected and enhanced corners of the container 10.

Figure 5:
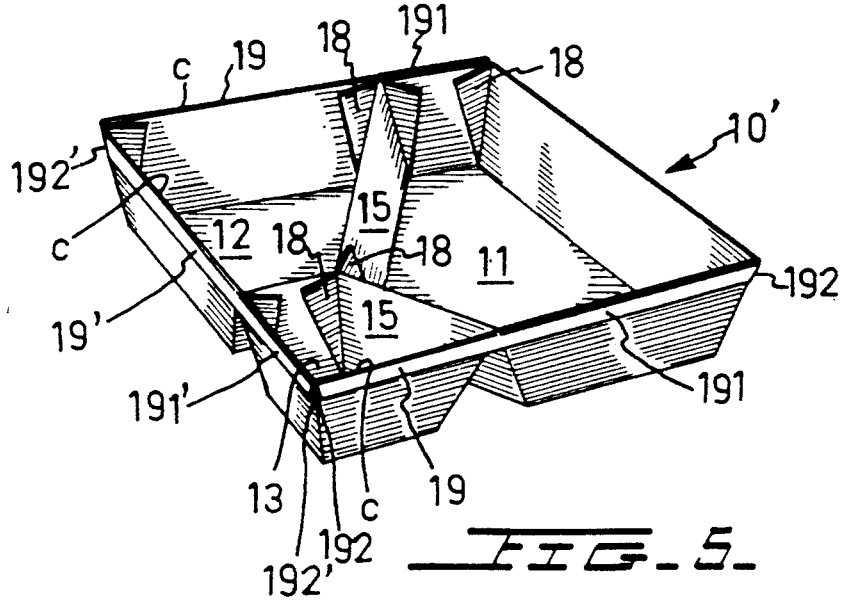
FIG. 5 shows the paper container folded, heat-sealed and finally formed from the paper pattern of FIG. 4.

Please refer to FIGS. 4 and 5 in which another embodiment of the present invention is shown. To meet actual requirements, the position of the openings 16, 17 can be changed to vary the related partitioning wall sections 15 and corner connection sections 18, and accordingly, the sizes, shapes and positions of the large and small bottom sections 11, 12 and 13. In the embodiment shown in FIGS. 4, 5, the transverse top edge strip section 19' is changed to adjoin the peripheral wall section 14 of only one small bottom section 12 and have a projected portion 191' extending toward the other small bottom section 13. When the paper pattern is folded and heat-sealed, the corresponding corner connection sections 18 are folded and overlapped, making the bottom sections 11, 12 and 13 become basin-like compartments. Meanwhile, the projected portions 191, 191' get near to the peripheral wall sections 14 of the bottom sections 11, 13, respectivley, and the top edge strip sections 19, 19' can be folded outward to be fitted and attached and be heat-sealed to the peripheral wall sections 14 of the bottom sections 11, 13. A paper container 10' having three compartments, each of different size, shape and position, is thereby formed to create different containing effects.

Figure 6:
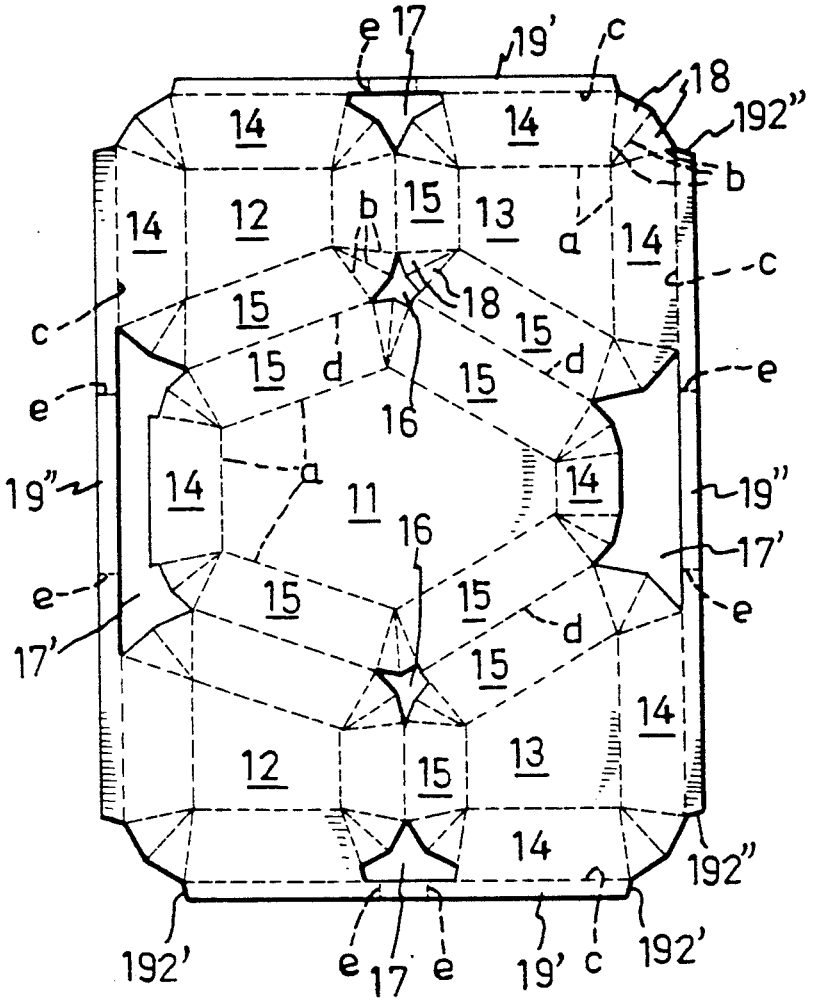
FIG. 6 is an unfolded paper pattern of a third embodiment of the paper container of the present invention.
Figure 7:
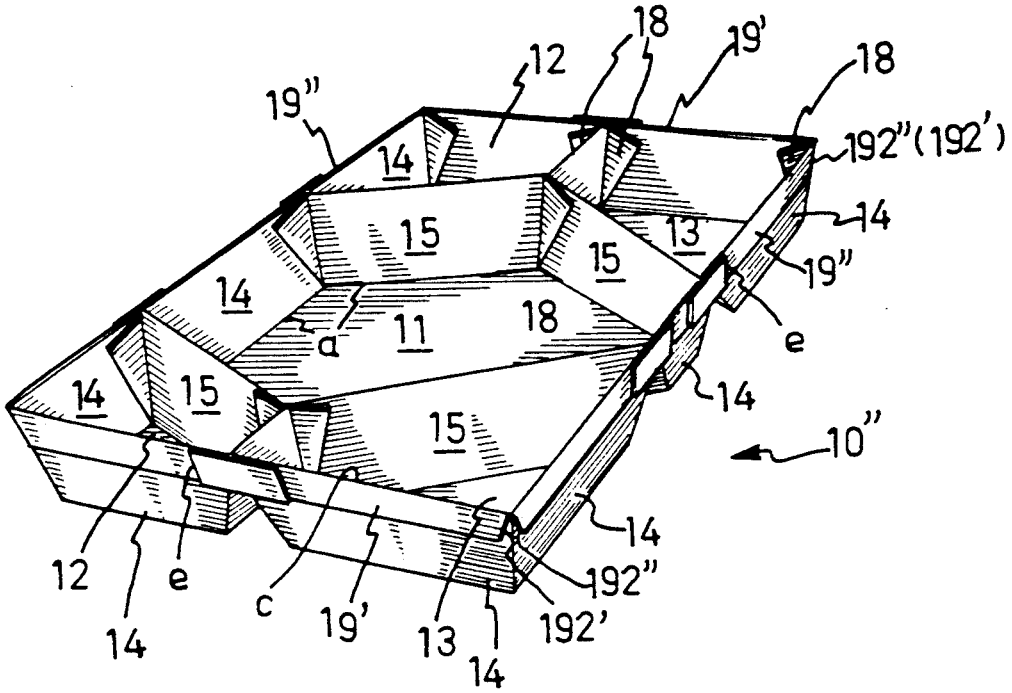
FIG. 7 shows the paper container folded, heat-sealed and finally formed from the paper pattern of FIG. 6.

Please now refer to FIGS. 6 and 7 which show another variation of the unfolded paper pattern of FIG. 1, wherein an outer side of the large bottom section 11 is extended to include two additional small bottom sections 12, 13, respectively corresponding to the existing small bottom sections 12, 13, and thereby, two pairs of small bottom sections 12, 13 and a large bottom section 11 located therebetween is formed in a generally I-shaped paper pattern. An additional transverse top edge strip section 19' is formed on the opposite side of the paper pattern corresponding to the existed transverse top edge strip section 19' and two pairs of the first and the second openings 16, 17 are formed inside the paper pattern.

Two lateral top edge strip sections 19'' each connects the peripheral wall sections 14 of the two small bottom sections 12 or 13, and together with the large bottom section 11 define a third opening 17'. Two parallel folding lines e are formed on the top edge strip section 19'' such that when the adjacent corner connection sections 18 are folded and overlapped to erect the partitioning wall sections 15 and peripheral wall sections 14 surrounding the bottom sections 11, 12 and 13, the respective top edge strip sections 19', 19'' can be folded outward and the middle parts thereof can be overlapped by means of the folding lines e so that the respective top edge strip sections 19', 19'' can be flush with the top edges of the corresponding peripheral wall sections 14 and be heat-sealed thereto, forming a paper container 10'' with more compartments.

In addition, some of the partitioning wall sections 15 of the bottom sections 11, 12 and 13 can be alternatively designed to have less width (not shown) and the adjacent corner connection sections 18 can correspondingly have reduced dimensions such that when the paper pattern is folded and heat-sealed to form a container, the same will have partitioning walls 15 with different heights or all the partitioning walls 15 will have less height to meet actual requirements.

According to the above arrangements, the present invention can provide paper containers with multiple variable compartments for containing different articles or foods. Moreover, the partitioning walls of the container can have various heights to more suitably contain articles or foods in different shapes or volumes.

It is to be understood that the above description and drawings are only used for illustrating three embodiments of the present invention, and are not intended to limit the scope of the present Invention. Any variation and derivation from the above description and drawings should be included in the scope of the present invention.

What is claimed is:

1. A paper board foldable into a container with multiple compartments, the paper board formed from a polyethylene coated laminate of fibers and additives, and including a pattern comprising:

a) first and second precut openings within the pattern;

b) a plurality of first folding lines defining a larger bottom section and a first pair of smaller bottom sections, and the bottom sections not adjoining each other;

c) a plurality of pairs of partitioning wall sections, each pair of partitioning wall sections being located between two adjacent bottom sections and provided with a second folding line extending transversely therebetween, whereby each pair of partitioning wall sections may be folded about the second folding line to form an erected partitioning wall for separating the two adjacent bottom sections from each other;

d) a plurality of peripheral wall sections, each peripheral wall section adjoining one edge of a bottom section;

e) a plurality of corner connection sections, each corner connection section being disposed between either two adjacent peripheral wall sections, two adjacent partitioning wall sections or one peripheral wall section and one partitioning wall section, and each corner connection section being defined by a plurality of third folding lines for forming two adjacent equiangular triangles which may be folded, overlapped and heat-sealed to a wall section; and f) two longitudinal top edge strip sections and at least one transverse top edge strip section, each top edge strip section adjoining a peripheral wall section at a fourth folding line therebetween for permitting the top edge strip section to be outwardly folded about the fourth folding line towards and heat-sealed to the adjacent peripheral wall section to form the top edges of the container.

2. The paper board of claim 1 wherein the transverse top edge strip section includes two parallel folding lines at substantially its middle portion for permitting the transverse top edge strip section to be folded outward and overlapped to dispose the transverse top edge strip section flush with its adjacent peripheral wall section.

3. The paper board of claim 1 wherein each of the bottom sections is asymmetrical and the transverse top edge strip section including a projected portion extending toward a smaller bottom section.

4. The paper board of claim 1 wherein the larger bottom section is symmetrical and the first pair of smaller bottom sections are identical and laterally symmetrical.

5. The paper board of claim 4 further including:

a) a second pair of smaller bottom sections symmetrically disposed opposite the first pair of smaller bottom sections, with the larger bottom section being disposed between the first and second pairs of smaller bottom sections;

b) second and third precut openings symmetrically positioned opposite the first and second precut openings;

c) a second transverse top edge strip section; and d) fifth and sixth precut openings disposed adjacent the two longitudinal top edge strip sections.

6. The paper board of claim 5 wherein each of the longitudinal and transverse top edge strip sections includes two parallel folding lines at substantially its middle portion for permitting the top edge strip section to be folded outward and overlapped to dispose the top edge strip section flush with its adjacent peripheral wall section.

* * * * *